US006015330A

United States Patent [19]

Simmons et al.

[11] Patent Number: 6,015,330

[45] Date of Patent: Jan. 18, 2000

[54] HOPPING MODEL CAR

[76] Inventors: Donald Simmons, 8032 Ney Ave., Oakland, Calif. 94605; Larnell Simmons, 3236 Martin Luther King, Jr. Way, Oakland, Calif. 94609

[21] Appl. No.: 09/156,942

[22] Filed: Sep. 18, 1998

[51] Int. Cl.[7] ..... A63H 17/00

[52] U.S. Cl. ..... 446/437; 446/431

[58] Field of Search ..... 446/3, 431, 437, 446/448, 457, 458, 466, 470

[56] References Cited

U.S. PATENT DOCUMENTS

| | | | |
|---|---|---|---|
| 4,457,101 | 7/1984 | Matsushiro | 446/437 X |
| 4,466,214 | 8/1984 | Kulesza et al. | 446/437 |
| 4,540,379 | 9/1995 | Tachibana | 446/448 |
| 4,556,397 | 12/1985 | Arad et al. | 446/437 X |
| 4,580,994 | 4/1986 | Fauser et al. | 446/437 X |
| 4,591,346 | 5/1986 | Ikeda | 446/437 X |
| 4,666,420 | 5/1987 | Nagano | 446/437 X |
| 4,702,720 | 10/1987 | Konta et al. | 446/437 |
| 4,717,367 | 1/1988 | Stubenfoll et al. | 446/437 |
| 5,019,009 | 5/1991 | Chao-Chin et al. | 446/437 |
| 5,722,872 | 3/1998 | Simmons et al. . | |
| 5,785,576 | 7/1998 | Belton | 446/437 X |

*Primary Examiner*—Sam Rimell
*Attorney, Agent, or Firm*—Jack Lo

[57] ABSTRACT

A hopping model car includes a body, a pair of vertically adjustable rear wheels mounted near the rear of the body, a pair of vertically movable front wheels mounted near the front of the body, and an actuator connected to the front wheels. The car is balanced to have a center of gravity slightly in front of a rear axle. To use, the rear wheels are adjusted downwardly to raise the rear end of the car. The front wheels are quickly extended downwardly to propel the front end of the car into the air. The car is balanced for hopping with less power consumption and a less powerful actuator, and for causing the front end to fall realistically slowly.

20 Claims, 3 Drawing Sheets

HOPPING MODEL CAR

BACKGROUND OF THE INVENTION

1. Field of the Invention

This invention relates generally to motorized model cars.

2. Prior Art

Toy vehicles for performing various stunts are well known. My U.S. Pat. No. 5,722,872 (March 1998) shows a low rider model car. A pair of front wheels are rapidly extended downwardly by a solenoid for propelling the front end of the car into the air. However, the hopping height is limited by the small clearance between the rear bumper and the ground. Also, the front end would fall too quickly, and thus provide a relatively unrealistic display.

U.S. Pat. No. 4,580,994 to Fauser et al. shows a motorized toy car with a large lever extending through its top. When the lever is in a forward position, the vehicle's center of gravity is forward of the rear axle, so the front wheels ride on the ground. When the lever is pulled to a rearward position, the center of gravity is shifted by the weight of the lever to a position directly over the rear axle. The motor is also activated by the lever to provide rapid forward acceleration. The center of gravity is shifted by the acceleration to a position behind the rear axle, so that the front of the vehicle is lifted into the air for a "wheelie." However, the front end is only lifted during forward acceleration. When the vehicle is stopped, the front end is brought back down by inertia.

OBJECTS OF THE INVENTION

Accordingly, objects of the present hopping model car are:

- to provide a lowered body to simulated a low rider vehicle;
- to be drivable;
- to provide front wheels which can be repeatedly extended downwardly and retracted to propel the front end repeatedly into the air;
- to provide rear wheels which can be extended downwardly to make a taller fulcrum, so as to enable higher hops without having the rear end bottom out;
- to provide rear wheels which can be extended either automatically or manually;
- to be balanced for enabling hopping with less power consumption and a less powerful actuator; and
- to be balanced for slowing the fall of the front end to a realistic rate.

Further objects of the present invention will become apparent from a consideration of the drawings and ensuing description.

BRIEF SUMMARY OF THE INVENTION

A hopping model car includes a lowered body, a pair of vertically adjustable rear wheels mounted near the rear of the body, a pair of vertically movable front wheels mounted near the front of the body, and an actuator connected to the front wheels. The car is balanced to have a center of gravity slightly in front of a rear axle. To use, the rear wheels are adjusted downwardly to raise the rear end of the car. The front wheels are quickly extended downwardly to propel the front end of the car into the air. The car is balanced for hopping with less power consumption, and for causing the front end to fall realistically slowly.

Figure 1:
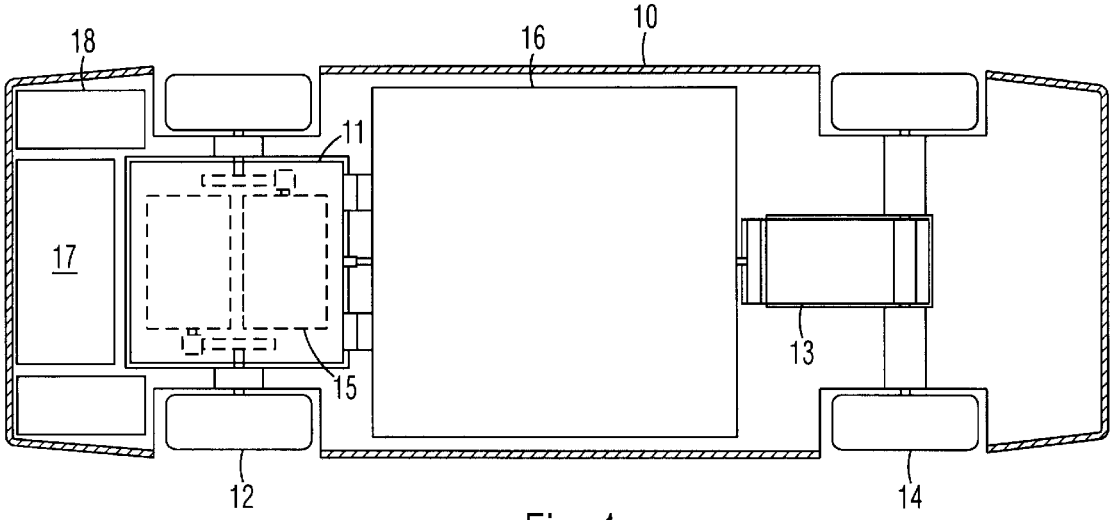
FIG. 1 is a top cutaway view of the present hopping model car.

| DRAWING REFERENCE NUMERALS | |
|---|---|
| 10. Body | 11. Drive Assembly |
| 12. Rear Wheels | 13. Lever |
| 14. Front Wheels | 15. Motors |
| 16. Circuit Board | 17. Batteries |
| 18. Weights | 19. Rod |
| 20. Actuator | 21. Rod |
| 22. Actuator | 23. Drive Assembly |
| 24. Finger Tab | 25. Detents |
| 26. Rear Axle | CG. Center-of-Gravity |

DETAILED DESCRIPTION OF THE INVENTION

FIGS. 1–2:

A first embodiment of the hopping model car is shown in the top cutaway view in FIG. 1. It includes a car body 10, a drive assembly 11 positioned near the rear of body 10 and hinged thereto, a pair of rear wheels 12 attached to opposite sides of drive assembly 11, a lever 13 positioned near the front of body 10 and hinged thereto, and a pair of front wheels 14 attached to lever 13. Rear wheels 12 are independently driven by a pair of motors 15 in drive assembly 11. A circuit board 16 is attached near the center of body 10, and preferably contains conventional electronics well known in the art for enabling the model car to be operated by a remote controller (not shown). A battery pack 17 and weights 18 are attached to the rear of body 10.

Figure 2:
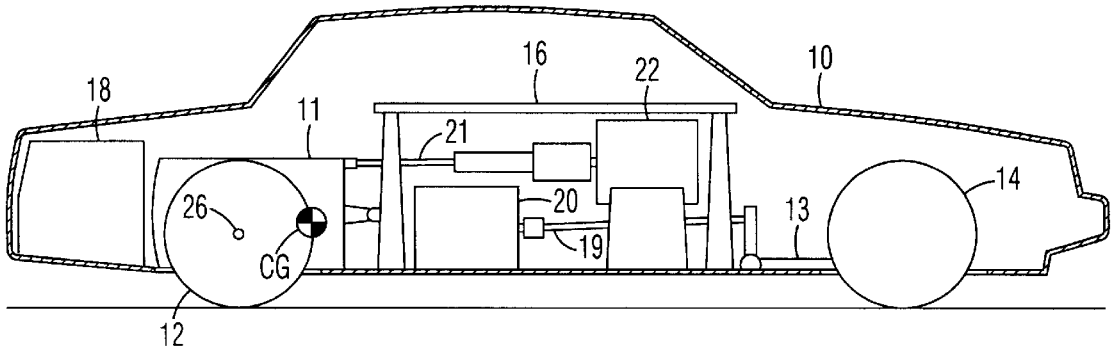
FIG. 2 is a side cutaway view of the model car in a neutral position.

As shown in the side cutaway view in FIG. 2, lever 13 is L-shaped. The front of its horizontal portion is connected to front wheels 14, its elbow is hinged to body 10, and the top of its vertical portion is in engagement with the distal end of a rod 19 attached to a quick-acting actuator 20, such as a solenoid. The top front of drive assembly 11 is connected to another rod 21 attached to a slower-acting actuator 22, such as a motor with a worm drive. The model car is balanced by battery pack 17 and weights 18 to have a center-of-gravity CG slightly ahead of a rear axle 26, preferably near the front edge of rear wheels 12. The CG may be aligned anywhere along a vertical direction near the front edge of rear wheels 12. The model car can be driven by actuating drive assembly 11. The model car is shown in a neutral position when body 10 is lowered close to the ground, i.e., when all four wheels are retracted upwardly to simulate an actual low rider vehicle.

Figure 3:
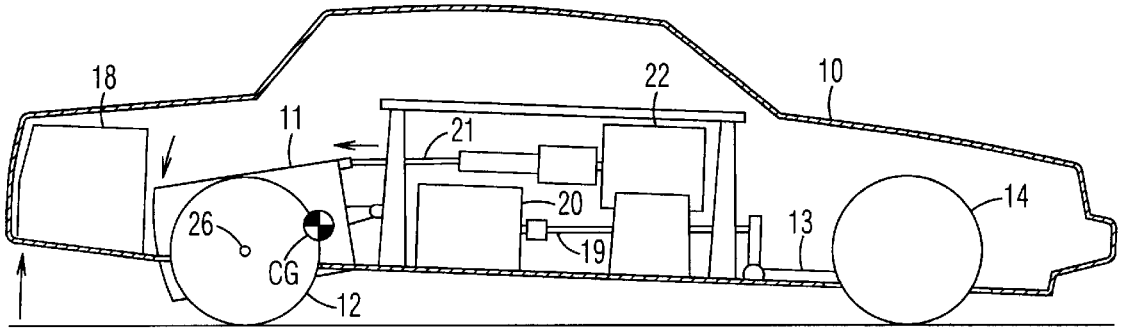
FIG. 3 is a side cutaway view of the model car with the rear wheels extended downwardly.

FIGS. 3–5:

Before the model car is made to hop, rod 21 is extended by actuator 22 to extend rear wheels 12 and drive assembly 11 downwardly, i.e., to raise the rear end of the model car, as shown in FIG. 3.

Figure 4:
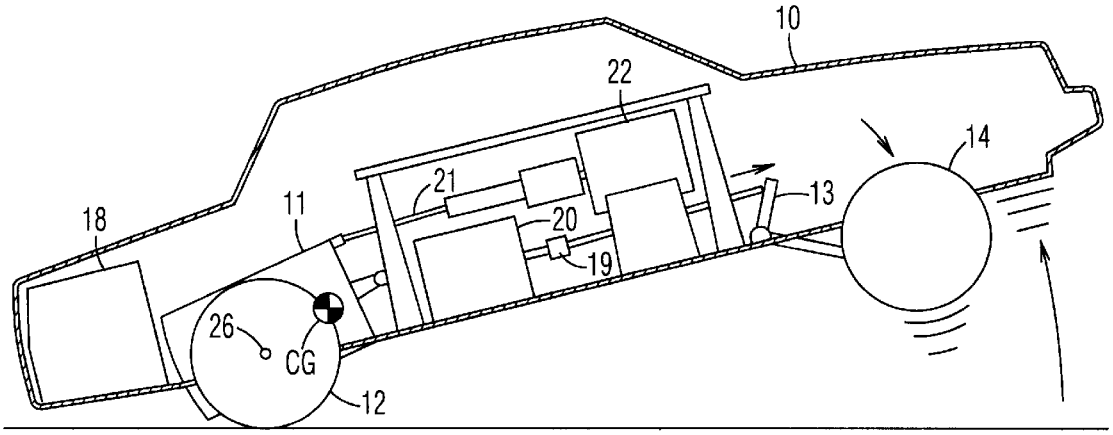
FIG. 4 is a side cutaway view of the model car with the front wheels extended downwardly forcefully enough to cause the front end to hop up.

The model car is made to hop by quickly extending rod 19 with actuator 20 to pivot lever 13 and front wheels 14 downwardly, as shown in FIG. 4. The front end of the model car is thus propelled into the air by the rapid downward extension of front wheels 14. Rear wheel 12 thus serve as the fulcrum of the pivoting model car. Because rear wheels 12 are extended downwardly, the height of the fulcrum is tall enough to allow the front end to be propelled to an impressive height without having the rear end bottom out. Even at the highest point of the hop, the center-of-gravity CG remains in front of rear axle 26. Because the center-of-gravity CG is close to rear axle 26, the front end is lightly loaded, so that it can be propelled rapidly upward with relatively little force for conserving battery power and allowing the use of a less powerful and less expensive actuator.

Figure 5:
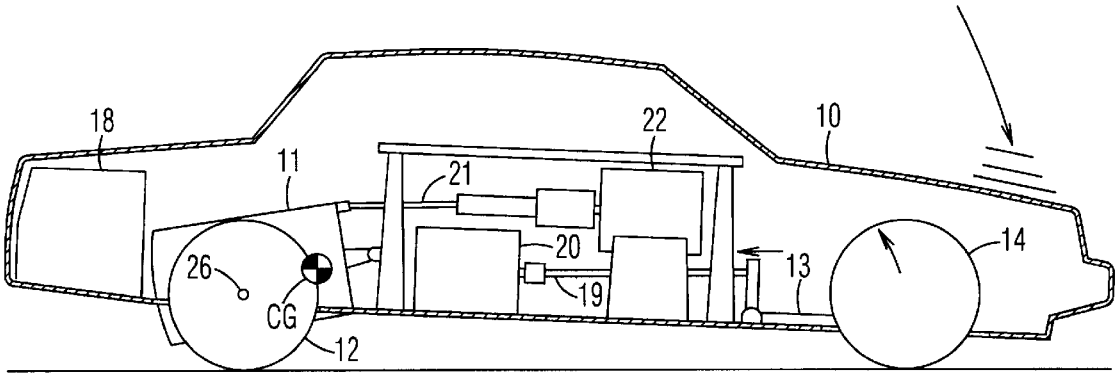
FIG. 5 is a side cutaway view of the model car when the front end has fallen back onto the ground.

After front wheels 14 are extended, they are retracted when the front end has fallen back to the ground, as shown in FIG. 5, so they can be extended again for another hop. The center-of-gravity CG is close enough to rear axle 26 to slow the fall of the front end to a realistically low rate.

Figure 6:
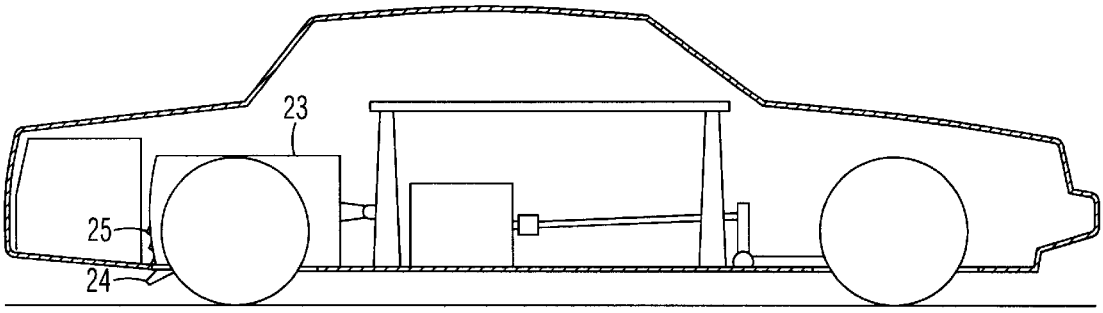
FIG. 6 is a side cutaway view of an alternative embodiment of the model car in a neutral position.
Figure 7:
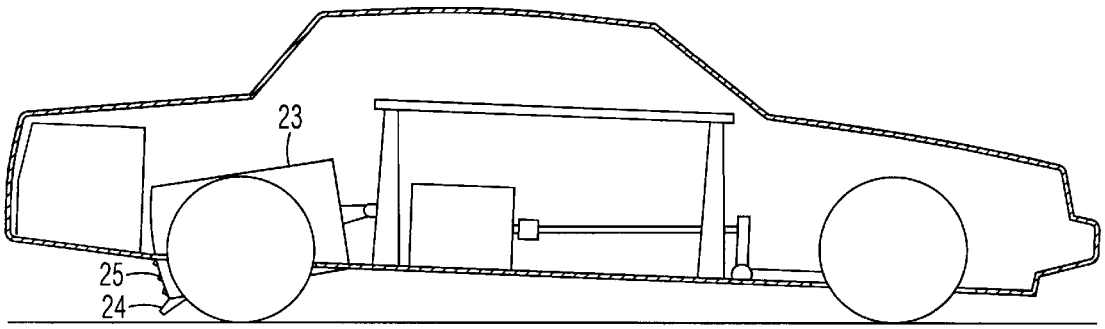
FIG. 7 is a side cutaway view of the model car of FIG. 6 with the rear wheels extended downwardly.

FIGS. 6–7:

An alternative embodiment of the model car is shown in a side cutaway view in a neutral position in FIG. 6. It is the same as the first embodiment, except for a hinged drive assembly 23 which has a finger tab 24 and detents 25 for being manually extended, as shown in FIG. 7. Multiple detents 25 are provided for selecting different degrees of extension.

SUMMARY AND SCOPE

Accordingly, a hopping model car is provided. It has a lowered body that simulates a low rider vehicle. It is drivable. It has front wheels which can be repeatedly extended downwardly and retracted to propel the front end repeatedly into the air. It has rear wheels which can be extended downwardly to provide a taller fulcrum, so as to enable taller hops without having the rear end bottom out. It has rear wheels which can be extended either automatically or manually. It is balanced for enabling hopping with less power consumption and a less powerful actuator, and for causing the front end to fall slowly for more realistic action.

Although the above description is specific, it should not be considered as a limitation on the scope of the invention, but only as an example of the preferred embodiments. Many variations are possible within the teachings of the invention. For example, other actuating mechanisms can be provided for moving the front and rear wheels up and down. The actuator for the front wheels may be arranged to pull the rod instead of pushing it, in which case the L-shaped lever would be inverted from the position shown to still move the front wheels downwardly. The wheels can be moved linearly instead of pivotally. All the internal components can be repositioned for balance. Small changes in the positioning of the center of gravity may be made for fine tuning the falling rate of the vehicle. The front wheels can be made steerable. Therefore, the scope of the invention should be determined by the appended claims and their legal equivalents, not by the examples given.

We claim:

1. A hopping model car, comprising:

a body;

a pair of vertically adjustable rear wheels mounted near a rear end of said body, said rear wheels being adjustable between an upwardly retracted position and a downwardly extended position relative to said body;

a pair of vertically movable front wheels mounted near a front end of said body, said front wheels being movable between an upwardly retracted position and a downwardly extended position relative to said body; and an actuator connected to said front wheels, said actuator extending said front wheels downwardly from said retracted position to said extended position, thus propelling said front end of said body upwardly into the air, further, said rear wheels can be adjusted downwardly to raise said rear end of said body, thus enabling said front end to be propelled higher without having said rear end bottom out.

2. The hopping model car of claim 1, wherein said actuator is comprised of a solenoid.

3. The hopping model car of claim 1, further including a L-shaped lever having an elbow hinged to said body, a horizontal portion of said lever being connected to said front wheels, and a vertical portion of said lever being connected to said actuator.

4. A hopping model car, comprising:

a body;

a pair of rear wheels mounted near a rear end of said body;

a pair of vertically movable front wheels mounted near a front end of said body, said front wheels being movable between an upwardly retracted position and a downwardly extended position relative to said body;

an actuator connected to said front wheels, said actuator extending said front wheels downwardly from said retracted position to said extended position, thus propelling said front end of said body upwardly into the air; and a center-of-gravity slightly ahead of an axle of said rear wheels, so that said front end of said body is lightly loaded, and when said front wheels are extended, said front end of said body is propelled upwardly with relatively little energy, and so that said front end would fall back at a realistically slow rate.

5. The hopping model car of claim 4, wherein said actuator is comprised of a solenoid.

6. The hopping model car of claim 4, wherein said center-of-gravity is generally aligned with a front edge of said rear wheels.

7. The hopping model car of claim 4, further including a L-shaped lever having an elbow hinged to said body, a horizontal portion of said lever being connected to said front wheels, and a vertical portion of said lever being connected to said actuator.

8. The hopping model car of claim 4, further including a battery pack positioned rearward of said axle of said rear wheels for improving balance.

9. The hopping model car of claim 4, further including a weight positioned rearward of said axle of said rear wheels for improving balance.

10. A hopping model car, comprising:

a body;

a vertically adjustable drive assembly positioned near a rear end of said body, said drive assembly being adjustable between an upwardly retracted position a downwardly extended position relative to said body;

a pair of rear wheels attached to said drive assembly and being driven thereby;

a pair of vertically movable front wheels mounted near a front end of said body, said front wheels being movable between an upwardly retracted position and a downwardly extended position relative to said body;

an actuator connected to said front wheels, said actuator extending said front wheels downwardly from said retracted position to said extended position, thus propelling said front end of said body upwardly into the air, further, said drive assembly and said rear wheels can be adjusted downwardly to raise said rear end of said body, thus enabling said front end to be propelled higher without having said rear end bottom out; and a center-of-gravity slightly ahead of an axle of said rear wheels, so that said front end of said body is lightly loaded, and when said front wheels are extended, said front end of said body is propelled upwardly with relatively little energy, and so that said front end would fall back at a realistically slow rate.

11. The hopping model car of claim 10, wherein said actuator is comprised of a solenoid.

12. The hopping model car of claim 10, wherein said center-of-gravity is generally aligned with a front edge of said rear wheels.

13. The hopping model car of claim 10, wherein said drive assembly includes a pair of motors individually driving said rear wheels.

14. The hopping model car of claim 10, wherein a front end of said drive assembly is hinged to said body, a rear end of said drive assembly being pivotable between said retracted position and said extended position.

15. The hopping model car of claim 10, wherein a front end of said drive assembly is hinged to said body, a rear end of said drive assembly being pivotable between said retracted position and said extended position, said drive assembly including a detent arranged on said rear end thereof enabling said drive assembly to maintain said extended position.

16. The hopping model car of claim 10, further including a second actuator connected to said drive assembly and moving said drive assembly between said retracted position and said extended position.

17. The hopping model car of claim 10, further including a second actuator with a worm gear connected to said drive assembly and slowly moving said drive assembly between said retracted position and said extended position.

18. The hopping model car of claim 10, further including a L-shaped lever having an elbow hinged to said body, a horizontal portion of said lever being connected to said front wheels, and a vertical portion of said lever being connected to said actuator.

19. The hopping model car of claim 10, further including a battery pack positioned rearward of said axle of said rear wheels for improving balance.

20. The hopping model car of claim 10, further including a weight positioned rearward of said axle of said rear wheels for improving balance.

* * * * *